US005590498A

United States Patent [19]

Mokres

[11] Patent Number: 5,590,498

[45] Date of Patent: Jan. 7, 1997

[54] ROOFING CANT STRIP

[76] Inventor: James A. Mokres, P.O. Box 23468, Santa Fe, N.M. 87502

[21] Appl. No.: 417,204

[22] Filed: Apr. 5, 1995

[51] Int. Cl.[6] ..... E04D 15/04; E04D 13/14

[52] U.S. Cl. ..... 52/287.1; 52/58; 52/717.04; 52/717.05

[58] Field of Search ..... 52/287.1, 219, 52/58, 94, 277, 273, 717.03, 717.05, 746.11, 717.04

[56] References Cited

U.S. PATENT DOCUMENTS

| | | | |
|---|---|---|---|
| 1,731,328 | 10/1929 | Witter | 52/58 |
| 1,739,077 | 12/1929 | Lisher et al. | 52/288.1 X |
| 1,843,107 | 2/1932 | Case | 52/58 X |
| 2,041,899 | 5/1936 | Brand | 52/273 |
| 2,137,889 | 11/1938 | Gillett | 52/58 |
| 2,303,864 | 12/1942 | Reasor | 52/287.1 X |
| 2,360,031 | 10/1944 | Andrews | 52/58 X |
| 2,541,768 | 2/1951 | Keller | 52/287.1 |
| 3,237,352 | 3/1966 | Edwards . | |
| 3,405,485 | 10/1968 | Edwards . | |
| 3,585,766 | 6/1971 | Jamieson . | |
| 4,759,157 | 7/1988 | Webb et al. . | |
| 4,829,730 | 5/1989 | Zeilinger | 52/287.1 |

*Primary Examiner*—Robert Canfield

[57] ABSTRACT

A cant strip piece for support of a roofing membrane member including a structure having at least five sides wherein a first side and a second side are perpendicularly joined at one edge defining a right angle, a third side is joined to both the first and second sides at an edge on each of said first and second sides oppositely situated from the edge at which said first and second sides are perpendicularly joined, said third side defining a concave shaped surface adapted for support of a roofing member transitioning from a horizontal plane to a vertical plane, said joined first, second and third sides defining a pair of end sides having surfaces situated in planes essentially perpendicular to a plane defined by said first or second sides is provided.

12 Claims, 1 Drawing Sheet

ROOFING CANT STRIP

FIELD OF THE INVENTION

The present invention relates to an improved roofing cant strip for use in roofing systems for parapet walls, skylight curbs or other construction details forming substantially 90 degree angles with a roof decking.

BACKGROUND OF THE INVENTION

Over the years, cant strips have been used by roofers, particularly by roofers applying built-up membrane systems of tar paper and asphalt, to provide a gentler angle for the membranes to follow when transitioning from a roof deck to a parapet wall, a skylight curb and the like. Typically, such cant strips have been made of wood or a wood fiber material and have had triangular shaped cross sections thereby providing a 45 degree angle instead of the 90 degree angle in the absence of such a cant strip. The goal has been to reduce the severity of any right angle turn by the membranes so that the membranes, which become brittle with age, do not crack and create leaks. A further reason for such cant strips is that the membrane material does not have much structural strength and requires solid support for the transition from the horizontal decking surface to the vertical wall surface.

Despite the use of such cant strips, problems remain. First, these triangular cross sectioned cant strips still create a stressful angle for the membranes to follow as the transition from the horizontal roofing deck to the triangular cross sectioned cant strip still requires a transition angle of 45 degrees and this often is too much angle for the roofing membrane to handle over time. In particular, asphalt membranes still have a tendency to crack and split at the 45 degree angle between the horizontal decking surface and the cant strip surface. Second, as the cant strip is made of wood or wood fiber material, they can absorb water and decompose if small cracks in the membrane go undetected and water penetrates to the cant strip surface. The cant strip can hold this moisture and subsequently promote dry rot of wood decking, sheathing or structural members.

Application of the current cant strips typically involves fastening by a mechanical means such as nailing. Further, to go around or inside corner sections upon a roof, cuts at the ends of the cant strips, usually 45 degree cuts must be made. All of this cutting and nailing adds to the installation time and hence, to the cost of the roofing job.

It is an object of the present invention to provide a cant strip capable of reducing the strain on the roofing membrane as it transitions from a horizontal surface to a vertical surface.

It is a further object of the present invention to provide a cant strip system having a preformed shape, especially ends, such that cutting and trimming expenses can be reduced.

Still another object of the present invention is to provide a cant strip suitable for application without nailing or other mechanical means.

A still further object of the invention is to provide a cant strip composed of a material resistant to degradation by moisture.

SUMMARY OF THE INVENTION

To achieve the foregoing and other objects, and in accordance with the purposes of the present invention, as embodied and broadly described herein, the present invention provides a cant strip piece for support of a roofing membrane member including a structure having at least five sides wherein a first side and a second side are perpendicularly joined at one edge defining a right angle, a third side is joined to both the first and second sides at an edge on each of said first and second sides oppositely situated from the edge at which said first and second sides are perpendicularly joined, said third side defining a concave shaped surface adapted for support of a roofing member transitioning from a horizontal plane to a vertical plane, said joined first, second and third sides defining a pair of end sides having surfaces situated in planes essentially perpendicular to a plane defined by said first or second sides.

In another embodiment of the invention, the cant strip pieces include adhesive material upon the surface defined by at least one of said first and second sides.

In another embodiment of the invention, the cant strip pieces include a layer of a heat resistant material upon the surface defined by said third side.

The present invention further provides a cant strip system for support of a roofing membrane member including a number of cant strip pieces, each individual piece being a structure having at least five sides wherein a first side and a second side are perpendicularly joined at one edge defining a right angle, a third side is joined to both the first and second sides at an edge on each of said first and second sides oppositely situated from the edge at which said first and second sides are perpendicularly joined, said third side defining a concave shaped surface adapted for support of a roofing member transitioning from a horizontal plane to a vertical plane, said joined first, second and third sides defining a pair of end sides having surfaces situated in planes essentially perpendicular to either plane defined by said first or second sides, said individual pieces having end sides configured for intimate contact with the end side of an adjacently situated cant strip piece.

DETAILED DESCRIPTION

The present invention is concerned with cant strips for the support of roofing membranes as such membranes transition from a horizontal roofing deck to any vertical surface such as a parapet wall and the like. Preferably, the cant strip is composed of a material resistant to degradation by moisture. Further, the cant strip can preferably be applied by a roofer to a roof surface without mechanical means such as nailing. Finally, the cant strip can preferably include selected preformed end shapes to eliminate a majority of cutting and/or trimming of the cant strip pieces for application at inner and outer corners of a roof.

Figure 1:
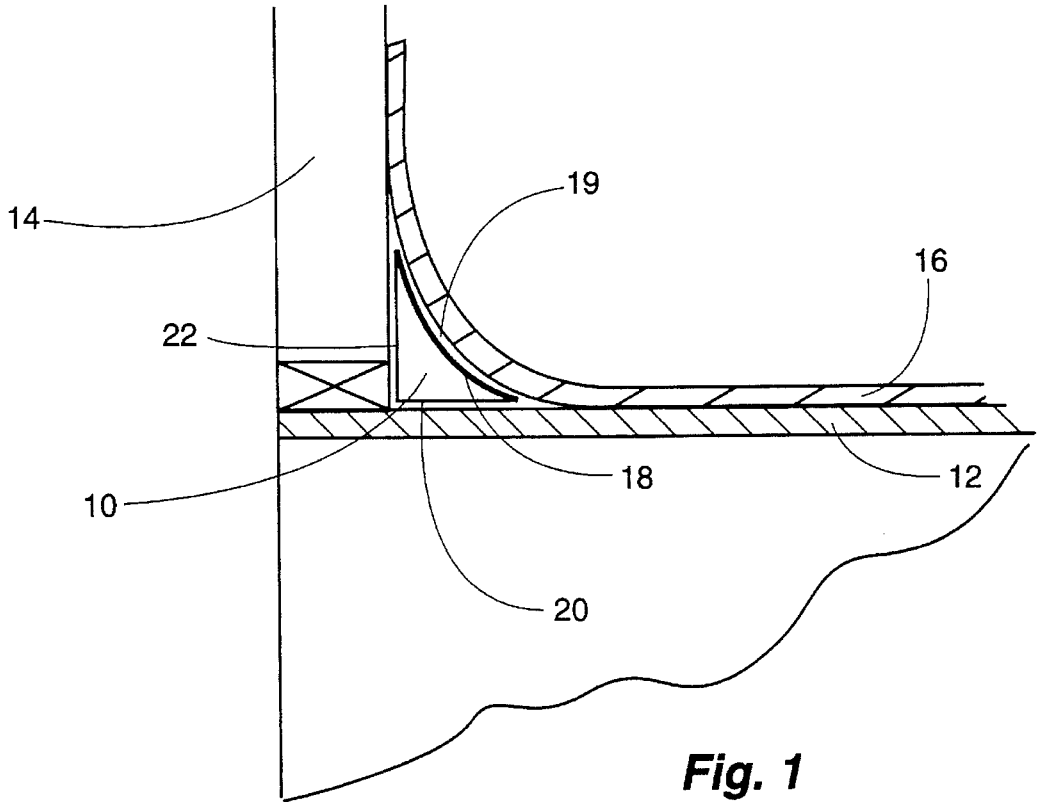
FIG. 1 is a transverse, sectional, elevational view illustrating the cant strip of the present invention positioned at the base of a parapet wall on a roof decking and supporting roofing membranes.

As shown in FIG. 1, a cant strip piece 10 is positioned on a roof decking 12 at the base of a vertical wall 14 over which a roofing membrane 16 is laid. The cant strip piece provides the membrane with a supportive, concave, smooth curved surface 18 to make the transition from the horizontal decking to the vertical wall with essentially no stress points.

The cant strip piece of the present invention is generally a five sided piece including a first and second side perpendicularly joined at one edge so as to define a right angle. This right angle is the corner of the cant strip piece that is aligned in the approximately 90 degree corner between the horizontal roof surface and the vertical surface of any adjacent wall. A third side joins both to the first and second sides at the edge on each of the first and second side located opposite to the edge at which the first and second sides are perpendicularly joined. This third side defines a concave surface with gradually changing angle from a horizontal plane to a vertical plane. These three joined sides then define the remaining two sides or ends opposedly located on the cant strip piece.

The concave curved surface 18 can essentially have a hyperbolic shape and allow the subsequent application of a membrane over the cant strip piece thereby allowing for the smooth gradual transition of the membrane from the horizontal surface of the roof deck to the vertical surface of an adjoining wall. This smooth gradual transition reduces stress points upon the membrane which can lead to cracking and additional deteriation with age.

In one embodiment, one or both of bottom 20 and back 22 of the cant strip piece can have a layer of an adhesive, preferably a tacky adhesive, capable of securing the cant strip to the roofing surface and/or vertical wall surface. Preferably, the cant strip piece can be an assembly also including a peel-off, i.e., a removable or releasable, covering strip over the adhesive layer until such time that it is removed and the cant strip piece is positioned on a roof. In this manner, the cant strip piece can be simply pressed into place by the applicator without the need for any mechanical fasteners such as nails.

Figure 2:
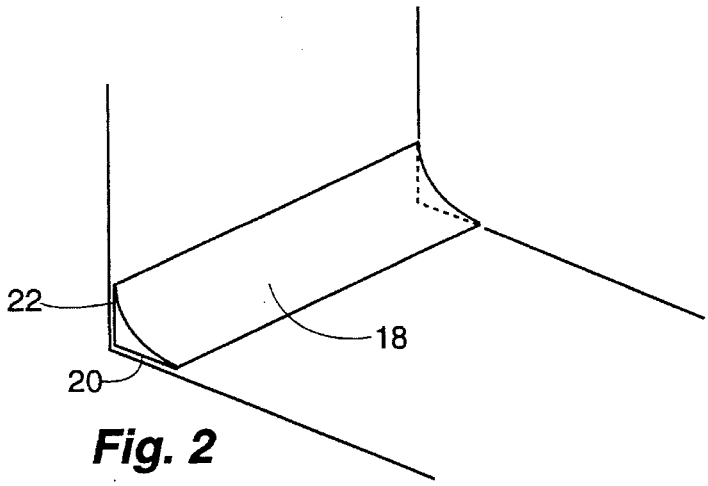
FIG. 2 is a perspective view of a four-foot, straight run piece of cant strip.
Figure 3A:
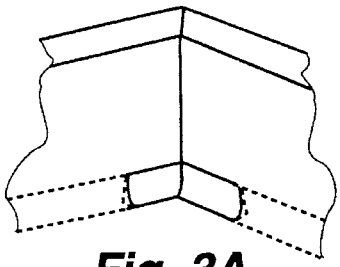
FIGS. 3(*a*) and 3(*b*) are perspective views of inside and outside corner pieces of cant strip.
Figure 3B:
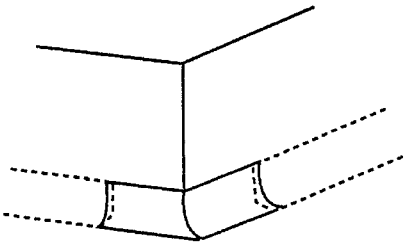

The cant strip piece can have a variety of shapes useful in an overall cant strip system. Included in the cant strip system are straight run cant strip pieces as shown in FIG. 2 and cant strip pieces having one or more preformed ends such as to serve as inside and outside corner pieces as shown in FIG. 3(*a*) and FIG. 3(*b*). The corner pieces can fit into appropriate ends of runs and thereby save applicator time and labor expense as cutting and trimming (to achieve, e.g., a 45 degree cut) can be eliminated. Then, along uninterrupted roofing runs terminating with either an inside or outside corner, only a single piece would need be cut to have the correct length for the roofing run. Installation of this cant strip system may allow the use of less skilled or less experienced workers thereby providing potential for further savings on labor.

The cant strip pieces of the present invention can be made of a polymeric material, such as, e.g., polystyrene, polyurethane, polyisocyanurate, closed glass celled foam, glass fiber mat facer, a phenol-based synthetic polymer, or a mineral aggregate insulation board of expanded perlite, cellulose fibers and waterproofing agents, e.g., Sealskin® which is lightweight and water resistant. The lighter weight material, as opposed to wood or wood fiber material, can make it easier to use as it would be easier to lift onto a roof and would be a lighter load on the roof. Such polymeric materials are generally easier to cut than wood or the like. Also, as such polymeric materials are typically water resistant, the possibility of any absorbed moisture causing damage to underlying wood decking, sheathing and the like may be reduced. Other materials such as perlite or fiberglass may also be used to form the cant strips and would offer the added benefit of fire retardency.

The cant strip piece can further include a layer of a heat resistant material upon the concave surface of the cant strip piece. Heat resistant material 19 shown in FIG. 2. Use of the layer of heat resistant material can serve to protect the cant strip piece from damage during application of hot asphalt in a roofing process which can lead to temperatures of about 475° C. Suitable heat resistant materials include a glass fiber mat facer, e.g., Celo-foam White Line®, an organic/inorganic facer, e.g., Celo-foam Ultra® or Celo-foam Pyrox®, fiberglass roof insulation formed of inorganic glass fibers bound by a resinous binder into a rigid form, optionally topcoated or surfaced with asphalt and kraft paper.

The present cant strip system offers: an increase in the longevity of roofing membranes by subjecting such membranes to less strain at horizontal to vertical transition zones; and, a reduction on the installation time and corresponding labor costs.

Although the present invention has been described with reference to specific details, it is not intended that such details should be regarded as limitations upon the scope of the invention, except as and to the extent that they are included in the accompanying claims.

What is claimed is:

1. A cant strip piece for support of a roofing membrane member comprising a structure having at least five sides wherein a first side and a second side are perpendicularly joined at one edge defining a right angle, a third side is joined to both the first and second sides at an edge on each of said first and second sides oppositely situated from the edge at which said first and second sides are perpendicularly joined, said third side defining a concave shaped surface adapted for the support of a roofing member transitioning from a horizontal plane to a vertical plane, said joined first, second and third sides defining a pair of end sides having surfaces situated in planes essentially perpendicular to either plane defined by said first or second sides, and a layer of a heat resistant material upon the surface defined by said third side.

2. The cant strip piece of claim 1 wherein at least one of said first and second sides includes adhesive material upon the surface defined by said side.

3. The cant strip piece of claim 1 wherein said first and second sides each include adhesive material upon the respective surface defined by said first and second sides.

4. The cant strip piece of claim 1 wherein said structure is formed of a polymeric material having a density less than the density of wood further characterized as substantially resistant to degradation by water.

5. The cant strip piece of claim 4 wherein said polymeric material is selected from the group consisting of polystyrene, polyurethane, and polyisocyanurate.

6. The cant strip piece of claim 2 further including a releasable covering strip situated against and over said adhesive material.

7. The cant strip piece of claim 3 further including a releasable covering strip situated against and over said adhesive material.

8. The cant strip piece of claim 1 wherein at least one of said end sides defines a surface situated in a plane intersecting either plane defined by said first or second sides at a predetermined angle within the range of from about 30 degrees to about 60 degrees.

9. The cant strip piece of claim 1 wherein at least one of said end sides defines a surface situated in a plane intersecting either plane defined by said first or second sides at an angle of about 45 degrees.

10. The cant strip piece of claim 1 wherein said structure is formed of a material selected from the group consisting of perlite and fiberglass wherein said structure is further characterized as substantially resistant to fire.

11. A cant strip system for support of a roofing membrane member comprising a number of cant strip pieces, each individual piece being a structure having at least five sides wherein a first side and a second side are perpendicularly joined at one edge defining a right angle, a third side is joined to both the first and second sides at an edge on each of said first and second sides oppositely situated from the edge at which said first and second sides are perpendicularly joined, said third side defining a concave shaped surface adapted for the support of a roofing member transitioning from a horizontal plane to a vertical plane, said joined first, second and third sides defining a pair of end sides having surfaces situated in planes essentially perpendicular to either plane defined by said first or second sides, said individual pieces having end sides configured for intimate contact with the end side of an adjacently situated cant strip piece, and a layer of a heat resistant material upon the surface defined by said third sides.

12. The cant strip system of claim 11 wherein at least two of said individual cant strip pieces, each individual cant strip piece having a major axis and having one end configured for intimate contact with another cant strip piece, are configured for forming a cant strip unit of two cant strip pieces forming an angle of less than 180 degrees between the major axis of said cant strip pieces.

* * * * *